US007958945B2

(12) United States Patent
Lu

(10) Patent No.: US 7,958,945 B2
(45) Date of Patent: Jun. 14, 2011

(54) PNEUMATIC TOOL WITH SECTIONAL ADJUSTMENT OF TORSIONAL FORCE

(75) Inventor: Kuo-Chou Lu, Da-an Township, Taichung County (TW)

(73) Assignee: Cheng Huan Industry, Ltd., Daija Township, Taichung County (TW)

( * ) Notice: Subject to any disclaimer, the term of this patent is extended or adjusted under 35 U.S.C. 154(b) by 152 days.

(21) Appl. No.: 12/537,423

(22) Filed: Aug. 7, 2009

(65) Prior Publication Data

US 2010/0031780 A1 Feb. 11, 2010

(30) Foreign Application Priority Data

Aug. 8, 2008 (TW) ..... 97130197 A

(51) Int. Cl.
*B25B 9/00* (2006.01)

(52) U.S. Cl. ..... 173/93.5; 173/168; 173/169

(58) Field of Classification Search ..... 173/93, 173/93.5, 168, 169, 104, 109, 213
See application file for complete search history.

(56) References Cited

U.S. PATENT DOCUMENTS

| | | | | | |
|---|---|---|---|---|---|
| 5,235,784 | A * | 8/1993 | Oki et al. | ..... | 451/355 |
| 5,377,769 | A * | 1/1995 | Hasuo et al. | ..... | 173/169 |
| 5,901,794 | A * | 5/1999 | Schoeps et al. | ..... | 173/93.5 |
| 5,964,302 | A * | 10/1999 | Lin | ..... | 173/169 |
| 6,158,528 | A * | 12/2000 | Izumisawa | ..... | 173/168 |
| 6,164,387 | A * | 12/2000 | Chang | ..... | 173/169 |
| 6,502,647 | B1 * | 1/2003 | Krzyzewski et al. | ..... | 173/170 |
| 6,644,419 | B1 * | 11/2003 | Chen | ..... | 173/169 |
| 6,932,165 | B1 * | 8/2005 | Sun et al. | ..... | 173/169 |
| 7,044,235 | B2 * | 5/2006 | Lin | ..... | 173/169 |
| 7,753,136 | B2 * | 7/2010 | Lu | ..... | 173/168 |

* cited by examiner

*Primary Examiner* — Scott A. Smith
(74) *Attorney, Agent, or Firm* — Egbert Law Offices PLLC

(57) ABSTRACT

The present invention provides a pneumatic tool enabling sectional adjustment of torsional force, including a main body and a cylinder mounted into the accommodation space of main body. The cylinder is fitted with air vents and also a rotor. A plurality of exhaust holes is arranged at one side of the cylinder tube of the cylinder. An exhaust duct switching member is arranged between the exhaust holes of the cylinder tube and air exhaust duct of the main body and used to switch the airflow for air exhaust by different exhaust holes. The pneumatic tool enables sectional adjustment of its torsional force, thus promoting the torsional force efficiently with better applicability.

4 Claims, 5 Drawing Sheets

PNEUMATIC TOOL WITH SECTIONAL ADJUSTMENT OF TORSIONAL FORCE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a pneumatic tool, and more particularly to an innovative tool to adjust the torsional force by switching a plurality of a plurality of exhaust holes.

2. Description of Related Art Including Information Disclosed Under 37 CFR 1.97 and 37 CFR 1.98

The pneumatic tools are generally used in such a manner that the torsional force has to be adjusted depending on the targets. The torsional force of conventional pneumatic tool is generally changed by adjusting the rotational speed of rotor through air intake regulating mechanism.

However, while external air is guided into the drive rotor of the cylinder of the pneumatic tool, the same squeezing stroke shall be required to make the air reach the exhaust hole of the cylinder. When air intake increases, the rotational speed and torsional force of the rotor cannot rise obviously due to the limitation of the fixed guiding and exhaust stroke. In such a case, the torsional force of conventional pneumatic tool cannot be improved or adjusted actually.

In addition, another typical structure has been developed in this industry, namely, with the forward offset of the exhaust hole of the cylinder. A shorter squeezing stroke for the guided air can be realized for a proper positive rotational torsion and a bigger reverse rotational torsion, but some shortcomings still exist, e.g. lack of adjustment flexibility in meeting the diversified customer requirements.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

Based on the unique present invention, it is mainly fitted with an exhaust duct switching member and a plurality of exhaust holes. The exhaust duct switching member can be used to control the draining hole of the rotary valve and to make it align with different exhaust holes of the cylinder tube so as to adjust the torsional force. As the stroke of air in the cylinder is changed, a longer stroke means a bigger driving force and torsional force for the rotor, and vice versa. The pneumatic tool of the present invention enables flexible adjustment of its torsional force with improved applicability.

Based on the structure of the exhaust duct switching member, comprised of a rotary valve, toggle and a plurality of channels, the present invention features simple construction, ease-of-operation while making it possible to save the fabrication, processing and assembly cost with better industrial and economic benefits.

Based on the structure of the air vents of the cylinder, being separately set into elongated grooves at both end surfaces of the cylinder tube, the cold air guided into the cylinder has an increased contact area with the cylinder tube wall. As the cylinder tube wall may yield high temperature due to the rotation of the rotor, this invention could apply the guided cold air to cool down both end surfaces of the cylinder tube, thus protecting the components and extending the service life with better applicability.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
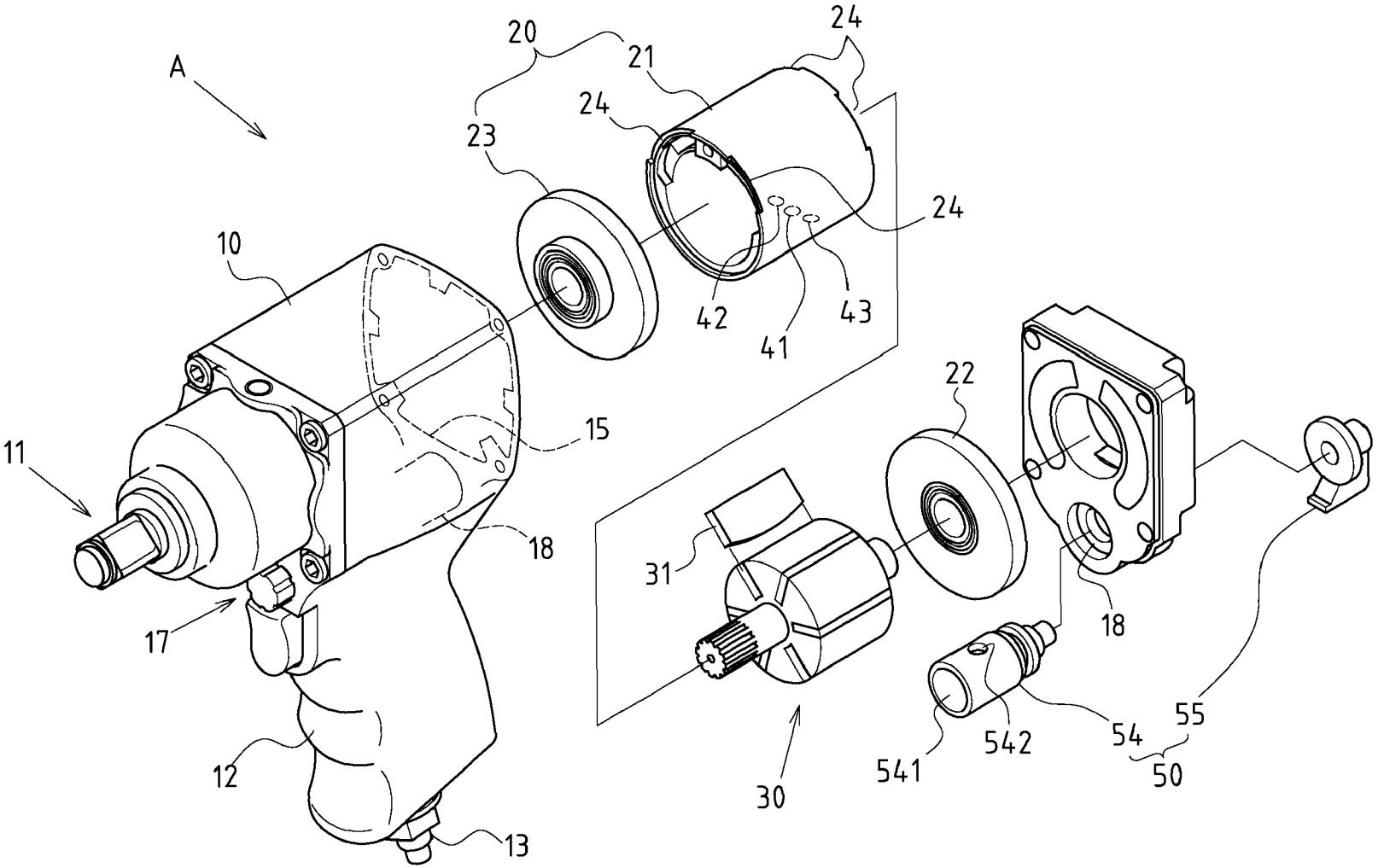
FIG. 1 shows an exploded perspective view of the preferred embodiment of the present invention.
Figure 2:
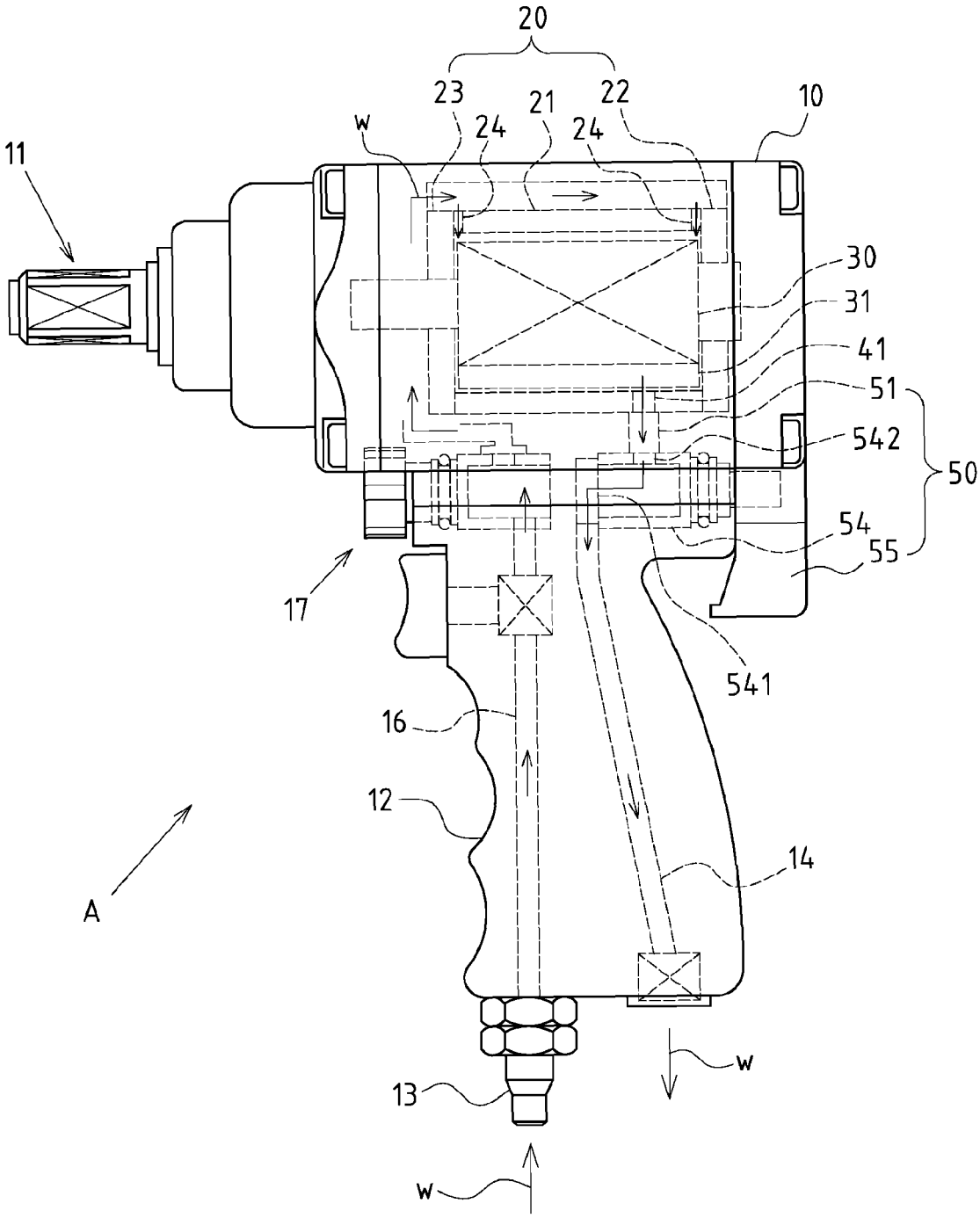
FIG. 2 shows a plane sectional view of the preferred embodiment of the present invention.
Figure 3:
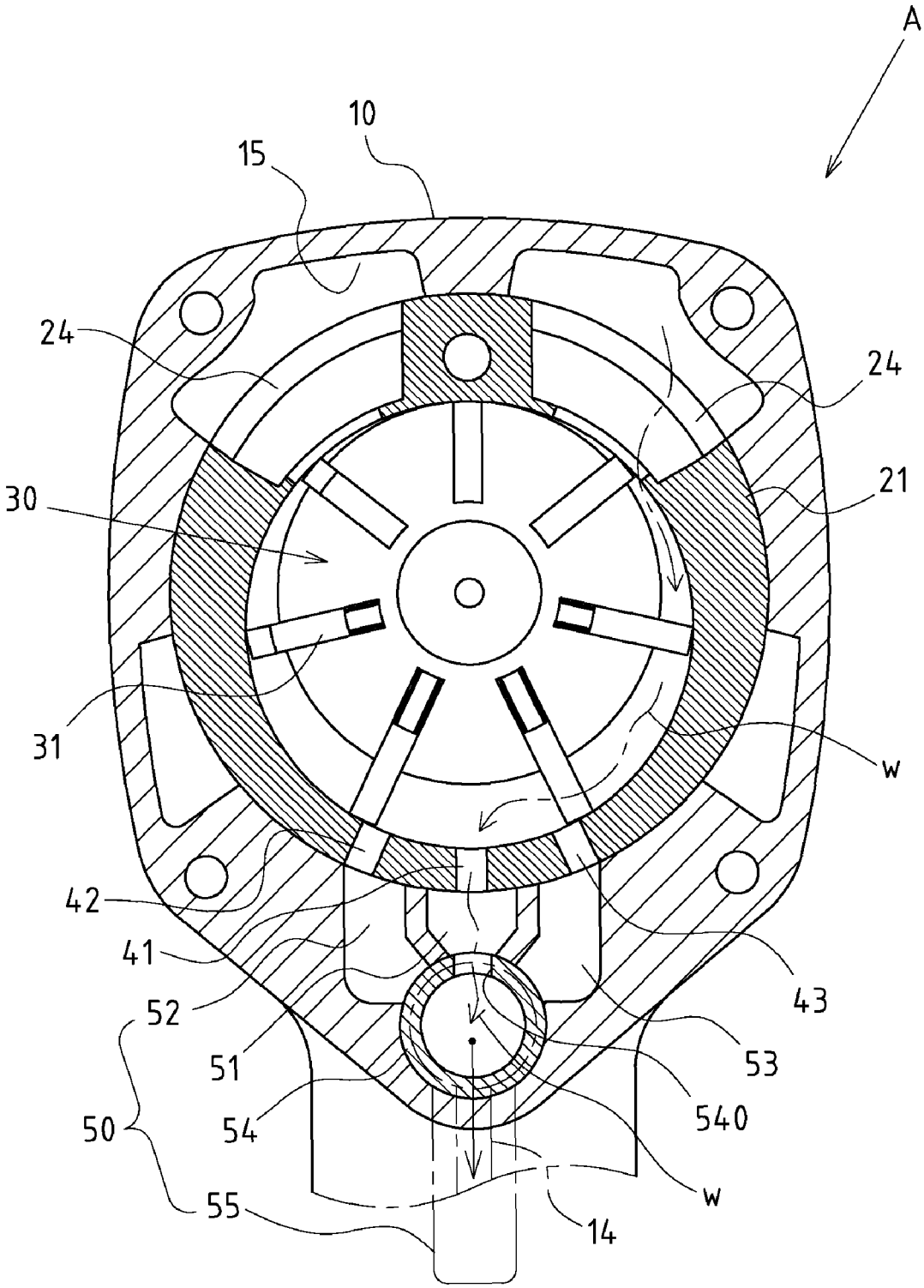
FIG. 3 shows a partial sectional view of a first preferred embodiment of the present invention, showing the air exhaust channels in an actuating state.

FIGS. 1-3 depict preferred embodiments of a pneumatic tool of the present invention enabling sectional adjustment of torsional force. The embodiments are provided for only explanatory purposes with respect to the patent claims.

The pneumatic tool A comprises a main body 10. At front end, an output shaft assembly 11 is mounted, and at bottom, a holding portion 12, an intake coupler 13 and an air exhaust duct 14 are arranged. The main body 10 is also provided with an accommodation space 15. Moreover, an air intake duct 16 in the holding portion 12 is linked to the intake coupler 13, and a bi-directional switcher 17 mounted on the front top of the holding portion 12 is used for switching air intake direction.

A cylinder 20 is mounted into the accommodation space 15 of the main body 10. The cylinder 20 includes a cylinder tube 21 and two end covers 22, 23. Moreover, the cylinder 20 is fitted with air vents 24 (including those generating positive or reverse rotation) for guiding air. The air vents 24 are separately placed into elongated grooves at both end surfaces of the cylinder tube 21.

A rotor 30 is eccentrically pivoted into the cylinder 20. The rotor 30 is fitted with movable vane 31. The rotor 30 can be rotated under the drive of air guided from the air vent 24, so as to interlock the output shaft assembly 11 for rotational operation.

A plurality of exhaust holes 41, 42, 43 is arranged at one side of the cylinder tube 21 of the cylinder 20, e.g. three groups of exhaust holes 41, 42, 43 shown in the preferred embodiment.

An exhaust duct switching member 50 is arranged between the exhaust holes 41, 42, 43 of the cylinder tube 21 and air exhaust duct 14 of the main body 10, and is used to switch the airflow for air exhaust by different exhaust holes 41, 42, 43.

A bi-directional switcher 17 is mounted between the air intake duct 16 and the cylinder 20 of the main body 10, so as to switch the positive or reverse air duct of the cylinder 20.

The exhaust duct switching member 50 is comprised of a rotary valve 54, a toggle 55 and a plurality of channels 51, 52, 53. A chamber 18 is arranged at intervals on the bottom of cylinder tube 21 of the cylinder 20 for accommodating the rotary valve 54. At the upper side of the chamber 18, the channels 51, 52, 53 are separately linked to the exhaust holes 41, 42, 43 of the cylinder tube 21. An air exhaust 541 at one end of the rotary valve 54 is normally connected to the air exhaust duct 14 of the main body 10. A draining hole 540 at one side of the rotary valve 54 may be aligned with different channels 51 or 52 or 53 with the varying angle of the rotary valve 54. The toggle 55 is mounted at external end of the rotary valve 54, allowing the users to toggle and drive the rotary valve 54.

Based upon above-specified structure, the present invention is operated as follows:

Referring to FIG. 2, there is a flow channel view of aforementioned preferred embodiment (a lateral view angle of pneumatic tool), wherein external air W is guided from the intake coupler 13 at bottom of the main body 10, then passes through air intake duct 16 in the holding portion 12 and also the bi-directional switcher 17, and next guided into the cylinder 20 to drive the rotor 30 via air vents 24 at both end surfaces of the cylinder tube 21. Air W is then discharged from the exhaust hole 41 (or 42,43) at lower part of the cylinder tube 21 of the cylinder 20, and furthermore discharged out of the main body 10 through air exhaust duct 14 of the holding portion 12.

Figure 4:
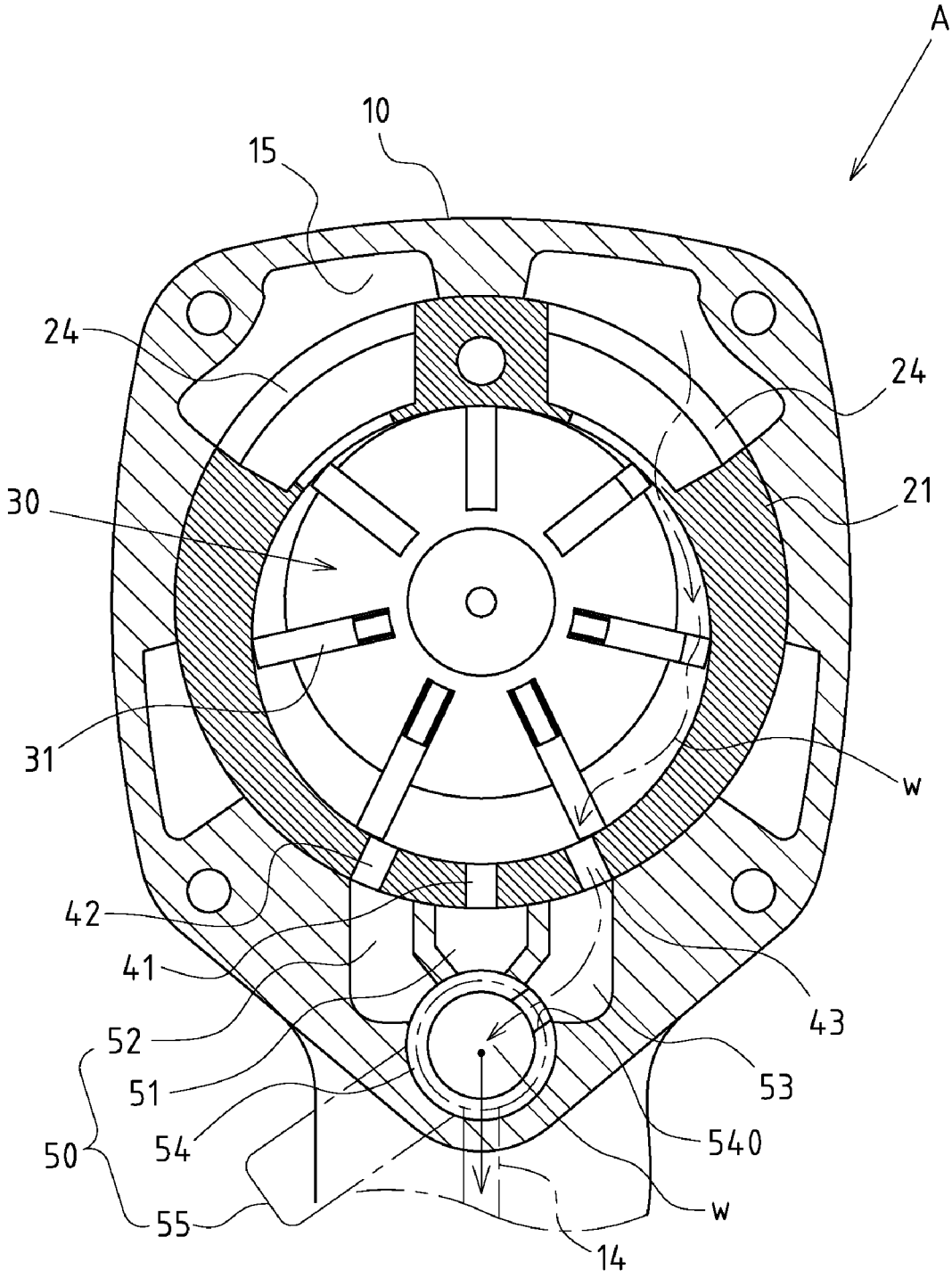
FIG. 4 shows a partial sectional view of a second preferred embodiment of the present invention, showing the air exhaust channels are in an actuating state.
Figure 5:
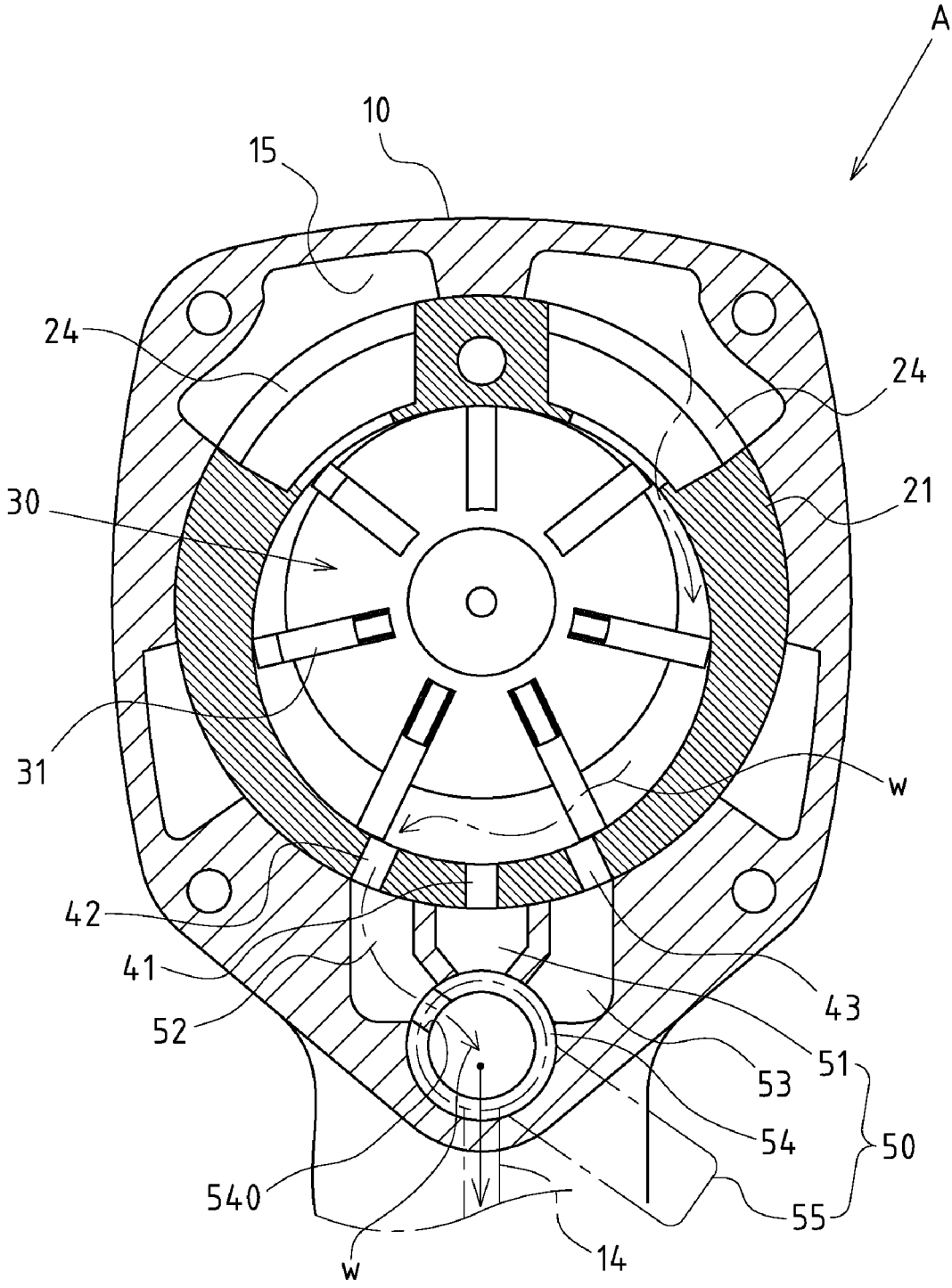
FIG. 5 shows a partial sectional view of a third preferred embodiment of the present invention, showing the air exhaust channels in an actuating state.

Referring to FIGS. 3, 4, and 5, the users may selectively adjust the air exhaust channels via the exhaust duct switching member 50, and then choose which exhaust hole 41, or 42 or 43 is used to exhaust air from the cylinder tube 21, so as to adjust the torsional force. As for three groups of exhaust holes 41, 42, 43 of the preferred embodiment, referring to FIG. 3, the toggle 55 of the exhaust duct switching member 50 is centrally localized so that the draining hole 540 of the rotary valve 54 is connected correspondingly with the intermediate channel 51 and exhaust hole 41. When the toggle 55 is turned to left end in the view (shown in FIG. 4), the draining hole 540 of the rotary valve 54 is connected correspondingly with the right-hand exhaust hole 43. When the toggle 55 is turned to right end in the view (shown in FIG. 5), the draining hole 540 of the rotary valve 54 is connected correspondingly with the left-hand exhaust hole 42. As the draining hole 540 of the rotary valve 54 is connected correspondingly with the can be aligned with different exhaust holes 41, 42, 43 of the cylinder tube 21, the guiding and exhaust stroke of air W to and from the cylinder tube 21 can be changed so as to modify the torsional force of the rotor 30. If the stroke of air W is relatively longer, the torsional force is increased with the growing driving force for the rotor 30. Otherwise, if the stroke of air W is relatively shorter, the torsional force of the rotor 30 is reduced. That is to say, the users can thereby make adjustments where necessary, for instance, when the bolt of the rotor 30 is loosened in a reverse rotation mode, a bigger torsional force is required. In such a case, the exhaust duct switching member 50 with a longer stroke of air can be adjusted. When the bolt of the rotor 30 is tightened in a positive rotation mode, only a smaller torsional force is required. In such a case, the exhaust duct switching member 50 with a shorter stroke of air can be adjusted.

I claim:

1. A pneumatic tool enabling sectional adjustment of torsional force, the tool comprising:

a main body, having an output shaft assembly mounted at a front end of said main body and being provided with a holding portion, an intake coupler, an air intake duct, air exhaust duct, and an accommodation space;

a cylinder, being mounted into the accommodation space of the main body and comprising a cylinder tube, two end covers and air vents;

a rotor, being eccentrically pivoted into the cylinder and fitted with a movable vane;

a plurality of exhaust holes, arranged at one side of the cylinder tube of the cylinder; and an exhaust duct switching member, arranged between the exhaust holes of the cylinder tube and air exhaust duct of the main body, and used to switch the airflow for air exhaust by different exhaust holes.

2. The tool defined in claim 1, wherein the exhaust duct switching member is comprised of a rotary valve, a toggle and a plurality of channels; and further comprising:

a chamber arranged at intervals on the bottom of cylinder tube of the cylinder for accommodating the rotary valve, said channels, at the upper side of the chamber, being separately linked to the exhaust holes of the cylinder tube;

an air exhaust at one end of the rotary valve connected to the air exhaust duct of the main body;

a draining hole at one side of the rotary valve aligned with different channels with the varying angle of the rotary valve; and a toggle mounted at an external end of the rotary valve, allowing to toggle and drive the rotary valve.

3. The tool defined in claim 1, further comprising:

a bi-directional switcher is mounted between the air intake duct and the cylinder of the main body, switching the positive or reverse air duct of the cylinder.

4. The tool defined in claim 1, wherein air vents of the cylinder are separately set into grooves at both end surfaces of the cylinder tube.

* * * * *